US008549725B2

(12) United States Patent
Neusch

(10) Patent No.: US 8,549,725 B2
(45) Date of Patent: Oct. 8, 2013

(54) C-SECTION POST AND POST-CABLE CONNECTOR METHODS FOR CABLE BARRIER SYSTEMS

(75) Inventor: William H. Neusch, Marble Falls, TX (US)

(73) Assignee: Neusch Innovations, LP, Burnet, TX (US)

( * ) Notice: Subject to any disclaimer, the term of this patent is extended or adjusted under 35 U.S.C. 154(b) by 0 days.

(21) Appl. No.: 13/621,107

(22) Filed: Sep. 15, 2012

(65) Prior Publication Data

US 2013/0008007 A1 Jan. 10, 2013

Related U.S. Application Data

(60) Division of application No. 12/534,554, filed on Aug. 3, 2009, now Pat. No. 8,286,950, which is a continuation of application No. 12/048,084, filed on Mar. 13, 2008, now Pat. No. 7,568,679, which is a continuation of application No. 11/175,940, filed on Jul. 6, 2005, now Pat. No. 7,364,137, application No. 13/621,107, which is a continuation of application No. 13/619,613, filed on Sep. 14, 2012, which is a continuation of application No. 12/040,322, filed on Feb. 29, 2008, now Pat. No. 8,266,803, which is a division of application No. 11/175,939, filed on Jul. 6, 2005, now Pat. No. 7,398,960.

(51) Int. Cl.
*B23P 11/00* (2006.01)
*B23P 17/00* (2006.01)

(52) U.S. Cl.
USPC ..... 29/525.01; 256/13.1; 256/52; 404/6

(58) Field of Classification Search
USPC ..... 29/446, 453, 525.01, 525.03; 256/13.1, 256/32, 35, 47, 48, 49, 52, 54; 404/6
See application file for complete search history.

(56) References Cited

U.S. PATENT DOCUMENTS

| | | | | | |
|---|---|---|---|---|---|
| 533,959 | A | * | 2/1895 | Leffler | 256/52 |
| 632,585 | A | * | 9/1899 | Parker | 256/56 |
| 812,141 | A | * | 2/1906 | Kidd | 256/52 |
| 826,984 | A | * | 7/1906 | Youngs | 256/49 |
| 830,108 | A | * | 9/1906 | Smith | 256/52 |
| 863,118 | A | * | 8/1907 | Trimble | 256/49 |
| 883,901 | A | * | 4/1908 | McInnis | 256/52 |
| 1,076,328 | A | * | 10/1913 | Swim | 256/52 |
| 1,107,858 | A | * | 8/1914 | Smith | 256/52 |
| 1,117,214 | A | * | 11/1914 | McFarland et al. | 256/52 |
| 1,136,746 | A | * | 4/1915 | White | 256/48 |
| 1,160,709 | A | * | 11/1915 | Gerken | 256/52 |

(Continued)

*Primary Examiner* — David Bryant
*Assistant Examiner* — Christopher Koehler
(74) *Attorney, Agent, or Firm* — Winstead PC; Henry L Ehrlich

(57) ABSTRACT

Post-cable connectors and cooperative C-section posts are utilized to releasably connect a cable in a cable barrier system to arrest errant motor vehicles that leave a roadway. A post-cable connector has an elongated section having a loop and a top section extending from the elongated section and terminating at a hook end for connecting the cable to the cooperative C-section post for example by hanging the top section of the post-cable connector from a back wall of the C-section post such that the elongated section is positioned in a cavity defined by the C-section post so that the loop is disposed through a slot in a face wall opposite from the back wall and positioned exterior of the cavity.

20 Claims, 9 Drawing Sheets

(56) References Cited

U.S. PATENT DOCUMENTS

| | | | | | |
|---|---|---|---|---|---|
| 1,207,021 | A | * | 12/1916 | Gossett | 256/52 |
| 1,249,186 | A | * | 12/1917 | Perry | 256/52 |
| 1,250,617 | A | * | 12/1917 | Montel | 52/155 |
| 1,267,568 | A | * | 5/1918 | McAllister | 256/52 |
| 1,360,375 | A | * | 11/1920 | Dammann | 256/54 |
| 1,643,100 | A | * | 9/1927 | Thomas | 256/52 |
| 1,754,712 | A | * | 4/1930 | Gartner | 256/54 |
| 2,854,101 | A | * | 9/1958 | Carper | 256/52 |
| 2,861,122 | A | * | 11/1958 | Flower | 174/146 |
| 3,161,263 | A | * | 12/1964 | Stokes | 248/218.4 |
| 3,266,778 | A | * | 8/1966 | Wogerbauer | 256/47 |
| 3,499,630 | A | * | 3/1970 | Dashio | 256/13.1 |
| 3,671,017 | A | * | 6/1972 | Sachs | 256/47 |
| 3,972,511 | A | * | 8/1976 | Balestrini | 256/47 |
| 4,119,302 | A | * | 10/1978 | Moroco et al. | 256/48 |
| 4,462,572 | A | * | 7/1984 | Hanneken | 256/52 |
| 4,595,176 | A | * | 6/1986 | Crabtree | 256/52 |
| 4,803,819 | A | * | 2/1989 | Kelsey | 52/309.1 |
| 4,867,421 | A | * | 9/1989 | Vernon | 256/54 |
| 4,881,721 | A | * | 11/1989 | Manley | 256/52 |
| 5,039,066 | A | * | 8/1991 | Stacey | 256/13.1 |
| 5,110,094 | A | * | 5/1992 | Kruse | 256/47 |
| 5,350,155 | A | * | 9/1994 | Burk | 256/48 |
| 6,695,293 | B1 | * | 2/2004 | Kamarad et al. | 256/48 |
| 6,857,621 | B1 | * | 2/2005 | Kamarad et al. | 256/48 |
| 6,932,327 | B2 | * | 8/2005 | Alberson et al. | 256/13.1 |
| 6,948,703 | B2 | * | 9/2005 | Alberson et al. | 256/13.1 |
| 7,556,242 | B2 | * | 7/2009 | Alberson et al. | 256/13.1 |
| 8,246,013 | B2 | * | 8/2012 | Mauer et al. | 256/48 |
| 2002/0014620 | A1 | * | 2/2002 | Nilsson | 256/59 |
| 2003/0213946 | A1 | * | 11/2003 | Alberson et al. | 256/13.1 |
| 2003/0222254 | A1 | * | 12/2003 | Bergendahl | 256/13.1 |

* cited by examiner

C-SECTION POST AND POST-CABLE CONNECTOR METHODS FOR CABLE BARRIER SYSTEMS

RELATED APPLICATIONS

This application is a division application of application Ser. No. 12/534,554, filed on Aug. 3, 2009, now U.S. Pat. No. 8,286,950, which is a continuation of application Ser. No. 12/048,084, filed on Mar. 13, 2008, now U.S. Pat. No. 7,568,679, which is a continuation of application Ser. No. 11/175,940, filed on Jul. 6, 2005, now U.S. Pat. No. 7,364,137.

This application is also a continuation application of application Ser. No. 13/619,613, filed on Sep. 14, 2012, which is a continuation application of application Ser. No. 12/040,322 filed on Feb. 29, 2008, now U.S. Pat. No. 8,266,803, which is a division of application Ser. No. 11/175,939, filed on Jul. 6, 2005, now U.S. Pat. No. 7,398,960.

BACKGROUND

The present disclosure relates in general to barriers and safety systems and more particularly to cable safety systems. Cable barrier systems are often employed to redirect errant objects (e.g., motor vehicles, falling rocks) toward a less hazardous path. Often, cable barrier systems are utilized along roadways and in the medians between roadways. For example, cable barrier systems may be utilized to redirect an errant motor vehicle headed toward oncoming traffic back into the intended direction of travel.

SUMMARY

Post-cable connectors and cooperative C-section posts are utilized to releasably connect a cable in a cable barrier system to arrest errant motor vehicles that leave a roadway. A post-cable connector has an elongated section having a loop and a top section extending from the elongated section and terminating at a hook end for connecting the cable to the cooperative C-section post for example by hanging the top section of the post-cable connector from a back wall of the C-section post such that the elongated section is positioned in a cavity defined by the C-section post so that the loop is disposed through a slot in a face wall opposite from the back wall and positioned exterior of the cavity.

In accordance with an embodiment a method for providing a cable barrier comprises providing a C-section post having opposing side walls defining a depth, a face wall and an opposing back wall defining a width, a cavity defined by the opposing side walls, face wall, and the back wall, and a slot formed through the face wall extending downward from a top end of the C-section post; and releasably connecting a cable to the C-section post via a post-cable connector comprising an elongated section disposed substantially within the cavity and a loop extending through the slot exterior of the cavity, the cable slidingly disposed in the loop, wherein when an object impacts and deforms the C-section post toward ground level the cable is released from the deformed C-section post in a manner such that the cable tends to stay in contact with the impacting object.

Another example of a method in accordance with an embodiment of the invention includes connecting a post-cable connector comprising an elongated section having a loop to a galvanized C-section post comprising a cavity defined by opposing side walls, a face wall and opposing back wall, a slot formed through the face wall and extending downward from a top end of the C-section post, the connecting the post-cable connector comprising hanging a top section of the post-cable connector from the top end of the back wall with the elongated section positioned within the cavity and the loop extending through the slot and positioned exterior of the cavity; disposing a cable through the loop; and disposing a member in the cavity between the elongated section and the face wall.

The foregoing has outlined some of the features and technical advantages in order that the detailed description that follows may be better understood. Additional features and advantages will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
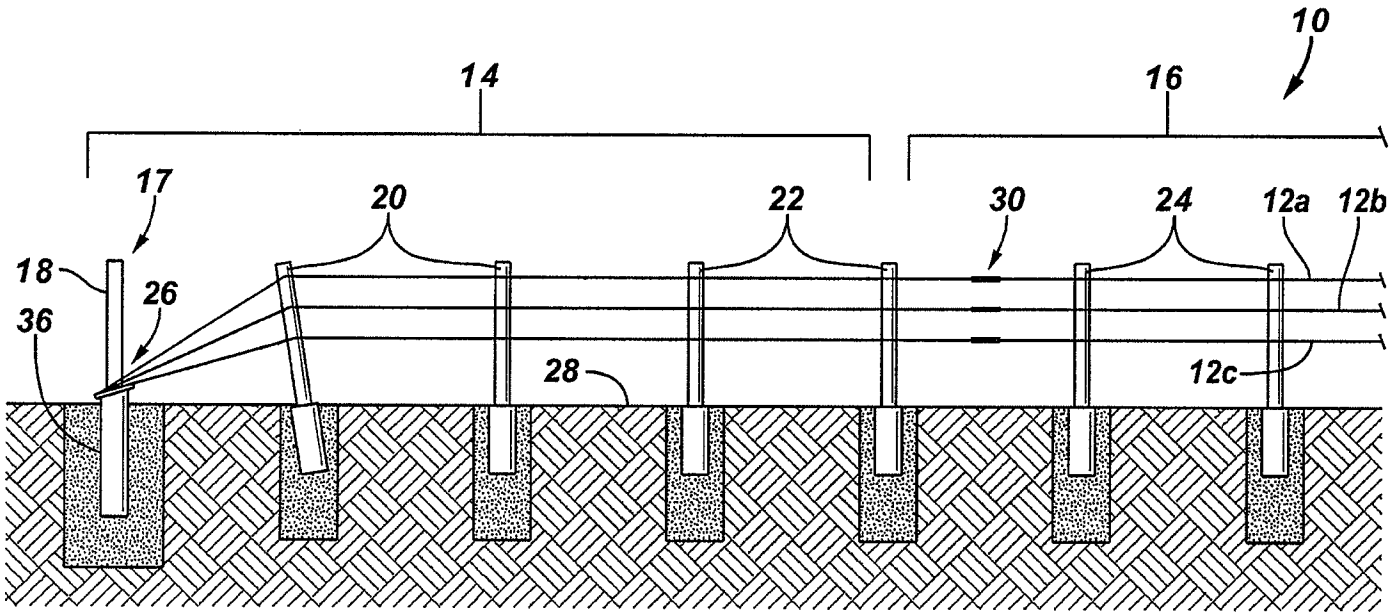
FIG. 1 is a schematic of a section of a cable barrier system according to one or more embodiments of the invention.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a schematic of a section of an embodiment of a cable barrier system according to one or more aspects of the invention, generally identified by the numeral 10. Cable barrier system 10 includes cables 12 held in tension from a terminal end 14 through a length of need 16. Cable barrier system 10 may include additional terminal ends 14 and intermediate terminal ends (not shown). System 10 is illustrated and described herein for exemplary purposes as a three-cable, highway median safety barrier, or cable guardrail. However, it should be realized that the various systems, assemblies, members and concepts described herein may be utilized in various installations and configurations for varying purposes. It should further be understood that various components of the invention may be utilized with various types and designs of barrier systems including, but not limited to, cable barrier systems, W-beam guardrail systems, crash cushions and attenuators.

Terminal end 14 includes a cable-release anchor 17 having a leveraging member 18, one or more weak terminal posts 20, and one or more standard terminal posts 22. The terminal ends 26 of cables 12 are removably mounted to cable-release anchor 17 substantially at ground level 28 and removably connected to terminal posts 20, 22 and line posts 24 of length of need (LON) section 16. Cables 12 are angled upward relative to ground level 28 through a portion of terminal end section 14 until the desired distance above ground level 26 is obtained. Terminal end 14 is a gated terminal wherein substantially no resistance is provided upon impact by an errant vehicle.

Length of need section 16 includes a plurality of spaced line posts 24. Cables 12 are removably connected to line posts 24 in tension. Length of need 16 may be any desired length. System 10 may include cable splice fittings 30 (FIG. 18) for extending and repairing cables 12. Additionally, cable splice fittings 30 may be utilized to maintain tension in cables 12.

Figure 18:
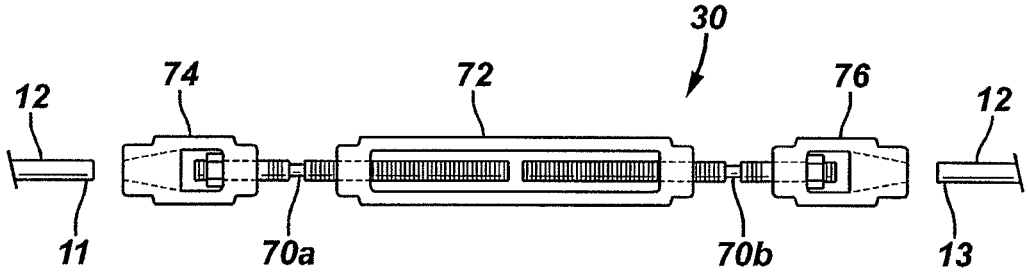
FIG. 18 is a view of a cable splice fitting according to one or more aspects of the invention.

Refer now to FIG. 18, wherein an embodiment of a cable splice fitting 30 according to one or more aspects of the invention is depicted. Cable splice fitting 30 may include a pair of elongated rods 70*a* and 70*b* connected by a turnbuckle 72. A first connector 74 is connected to elongated rod 70*a* and adapted to connecting to an end 11 of a cable 12. A second connector 76 is connected to elongated rod 70*b* and adapted to connecting to an end 13 of another cable 12. Cable splice fitting 30 facilitates forming and maintaining a spliced, elongated cable 12 in tension.

Referring back to FIG. 1, as is well known in the art, cables 12 are releasably connected to terminal posts 20, 22 and line posts 24 in a manner such that when an individual post fails and is moved toward the ground level 28, cables 12 are released from that individual post. For example, if a vehicle 38 (FIG. 3) impacts cable barrier system 10 in length of need section 16 and collapses one line post 24 toward the ground level 28, cables 12 are released from that line post 24 so that cables 12 remain supported above ground level 28 and in contact with the vehicle and do not go under the vehicle. The cables remain supported above ground level by the remaining portion of the cable barrier system thereby urging the vehicle back to its designated and desired path (i.e., roadway).

Figure 2:
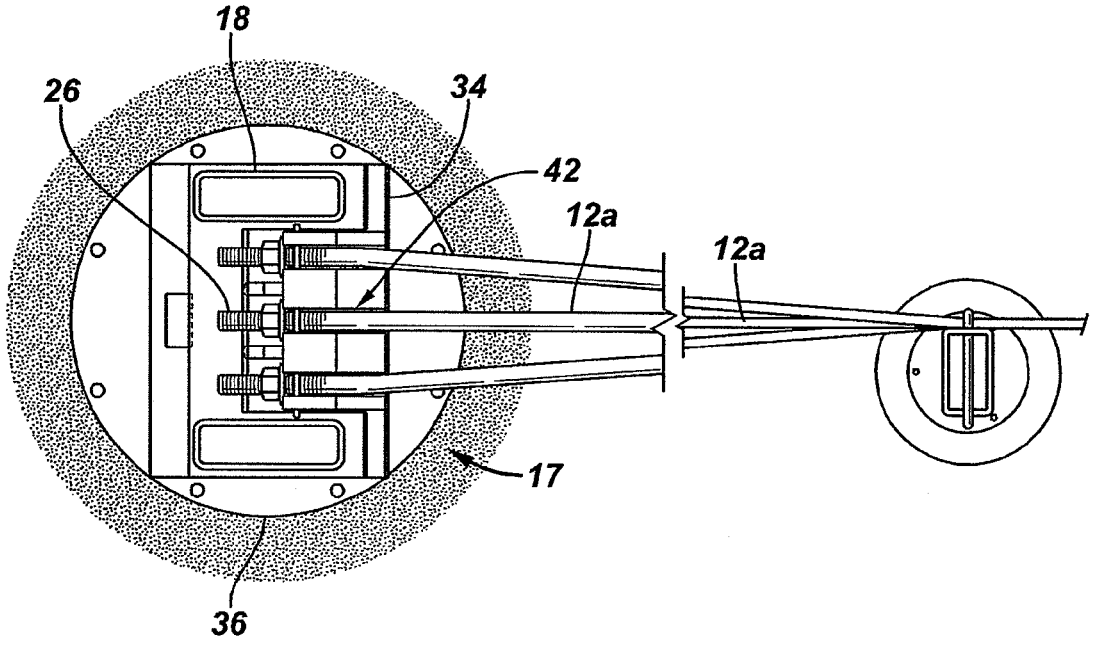
FIG. 2 is a top view of the cable-release anchor and the first terminal post of FIG. 1 in isolation.

FIG. 2 is a top view of cable-release anchor 17 and a first terminal post 20 of terminal end 14 according to one or more aspects of the invention, shown in isolation. Terminal ends 26 of cables 12 are removably connected at cable-release anchor 17. As described in further detail below, cable-release anchor 17 may take various designs such that cables 12 are released from tension when cable-release leveraging member 18 is struck by an errant vehicle thereby preventing the vehicle from riding up cables 12. Various embodiments of cable-release anchor 17 include, but are not limited to, an assembly as shown in FIGS. 4 through 9 and/or frangible pins.

Figure 3:
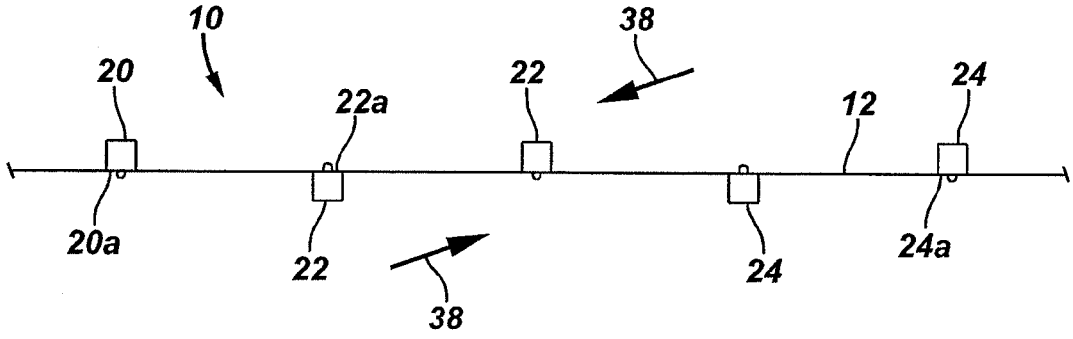
FIG. 3 is a top view of a portion of an embodiment of a cable barrier system according to one or more aspects of the invention.

As shown in FIG. 2, cables 12 are removably connected to a cable mounting plate 34. Desirably top cable 12*a*, relative to ground level 28, is removably connected in a center position on mounting plate 34. Cable mounting plate 34 is fixedly secured to the pad 36 of cable-release anchor 17. As described further below, pad 36 may take various forms including, but not limited to, being a metal support member. Leveraging member 18 is mounted atop mounting plate 34 with a portion positioned under terminal ends 26 of cables 12. Leveraging member 18 is not secured to mounting plate 34; as such it is dislodged upon being impacted by a vehicle 38 (FIG. 3). In accordance with one or more embodiment, when leveraging member 18 (e.g., vertical post) is struck with by a vehicle and dislodged, it leverages, or releases, cables 12 from cable-release anchor 17. In the illustrated embodiment, leveraging member 18 is an elongated member such as, but not limited to, a post. Leveraging member 18 is referred to herein broadly, and without limitation, as a post or anchor element, capable of leveraging cable(s) 12 out of connection with anchor plate 34.

FIG. 3 is a top view of a portion of an embodiment of cable barrier system 10 according to one or more aspects of the invention. System 10 illustrates one manner of mounting barrier system 10 for absorbing the impact from errant vehicles and redirecting the errant vehicles from two directions, such as for highway medians. Arrows 38 illustrate the direction of travel of vehicles impacting system 10. Posts 20, 22, and 24 each have a face 20*a*, 22*a*, and 24*a* respectively, adapted for removably mounting cables 12. Post faces 20*a*, 22*a*, and 24*a* are desirably oriented to face oncoming vehicles such that cables 12 are positioned between posts 20, 22, and 24 and the direction of vehicle travel 38. For applications wherein it is probable that vehicles may impact from either direction, posts 20, 22, and 24 may be installed such that at least a portion of post faces 20*a*, 22*a*, and 24*a* are oriented toward oncoming traffic. In the illustrated embodiment, posts 20, 22, and 24 are installed with each post face oriented opposite the orientation of the adjacent post faces.

Figure 4:
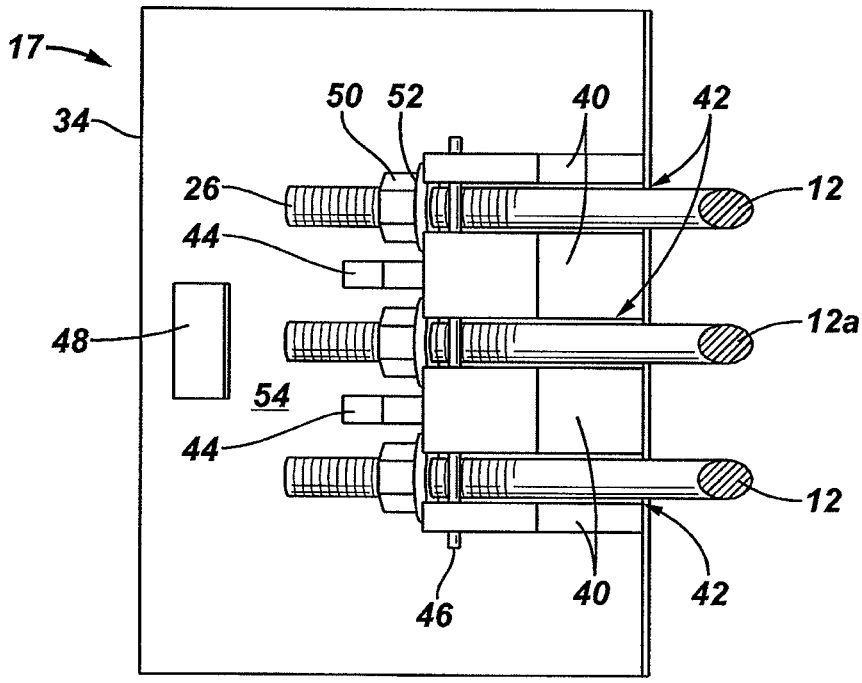
FIG. 4 is a top view of a portion of an embodiment of the cable-release anchor according to one or more aspects of the invention.
Figure 5:
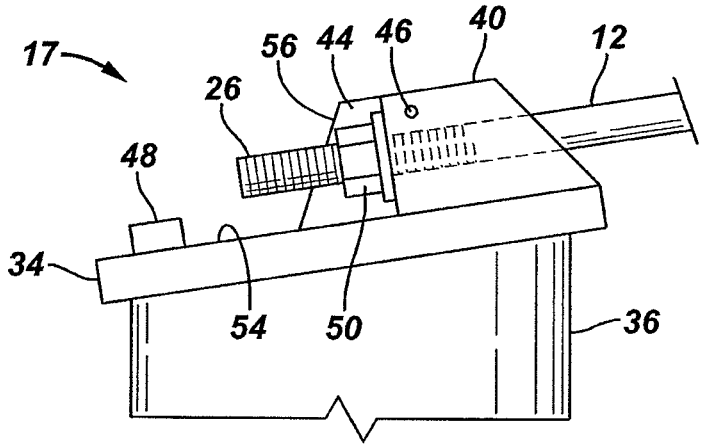
FIG. 5 is a side view of a portion of an embodiment of the cable-release anchor according to one or more aspects of the invention.

FIG. 4 is a top view of a portion of an embodiment of cable-release anchor 17 according to one or more aspects of the invention. Cable-release anchor 17 is shown in FIGS. 4 and 5 with leveraging member 18 (FIGS. 1, and 6 through 9) removed.

Cable-release anchor 17 includes a mounting plate 34. Mounting plate 34 includes a bracket 40 having a plurality of slots 42 each adapted to dispose a cable 12. In the illustrated embodiment slots 42 have an open top. It should be recognized that in other embodiments that the tops of slots 42 may not be open. Cables 12 are mounted in slots 42 with a terminal end fitting 50, illustrated in this embodiment as a nut 52 connected to threaded terminal end 26 of cable 12.

A rib 44 may be positioned between adjacent slots 42. An optional pin 46 is shown extending through bracket 40. Pin 46 is positioned above cables 12 and substantially perpendicular to the longitudinal axis of cables 12. Pin 46 provides stability: aiding in maintaining cables 12 in slots when tensioning cables 12; maintaining cables 12 in cable-release anchor 17 when cables 12 are impacted further down the length of system 10; maintaining cables 12 in connection with cable-release anchor 17 during weather related changes in cables 12; and reducing vibrations in cables 12.

A post stop 48 extends from the same side of mounting plate 34 as bracket 40. Post stop 48 is spaced from bracket 40 to define a leveraging member landing 54 (post landing). Anchor post landing 54 extends under terminal ends 26 of cables 12.

FIG. 5 is a side view of a portion of an embodiment of cable-release anchor 17 according to one or more aspects of the invention. Mounting plate 34 is fixedly connected atop pad 36. With reference to FIGS. 1 and 2, pad 36 may be a metal post and connected by welding. Pad 36 may be constructed in various manners as desired and pad 36 and mounting plate 34 connected in a sufficient and appropriate manner. For example, pad 36 may be a concrete pad wherein mounting plate or anchor plate 34 is connected via concrete bolts.

FIG. 5 depicts rib 44 having a rib face 56 oriented toward post landing 54. Desirably, rib face 56 is non-perpendicular and has an inclined slope away from landing 54. Rib face 56 is sloped to mate with leveraging member 18 as described in relation to FIGS. 6 through 9.

Figure 6:
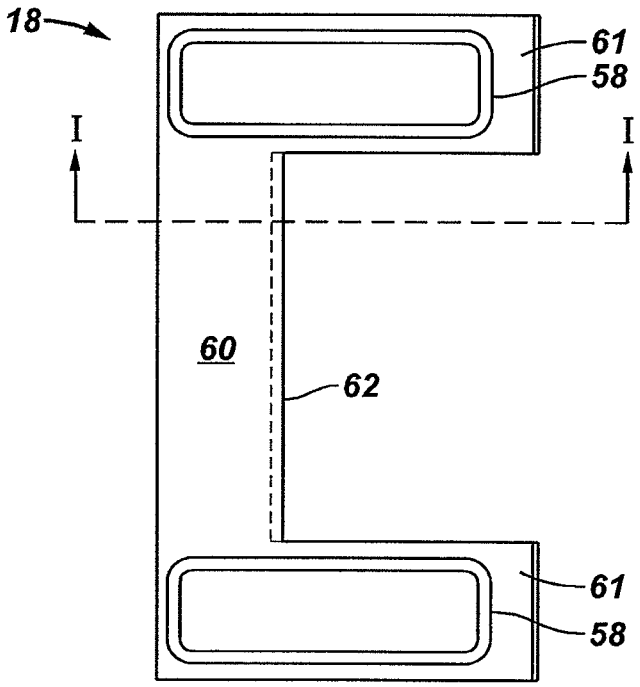
FIG. 6 is a top view of an embodiment of a cable-release anchor leveraging member according to one or more aspects of the invention.
Figure 7:
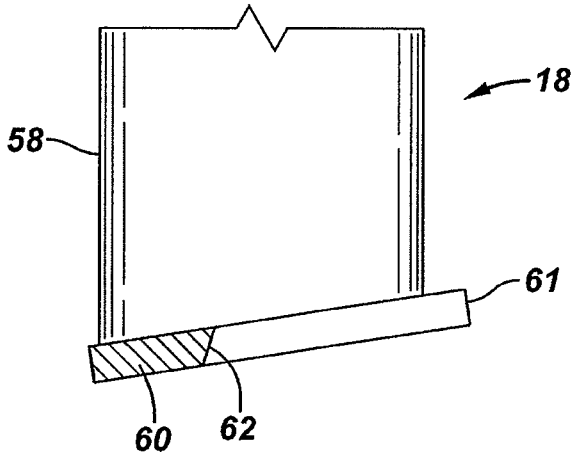
FIG. 7 is a side view of the cable-release anchor leveraging member along section line I-I of FIG. 6.

FIG. 6 is a top view of an embodiment of a cable-release leveraging member 18 according to one or more aspects of the invention. Leveraging member 18 of the depicted embodiment is a high strength steel member having a pair of legs 58 mounted atop feet 61 of a substantially C-shaped base 60. Base 60 includes a toe 62 formed between feet 58. Toe 62 is sloped to correspond with rib face 56 (FIG. 5). FIG. 7 is a side view of cable-release leveraging member 18 along section line I-I of FIG. 6 revealing toe 62.

Figure 8:
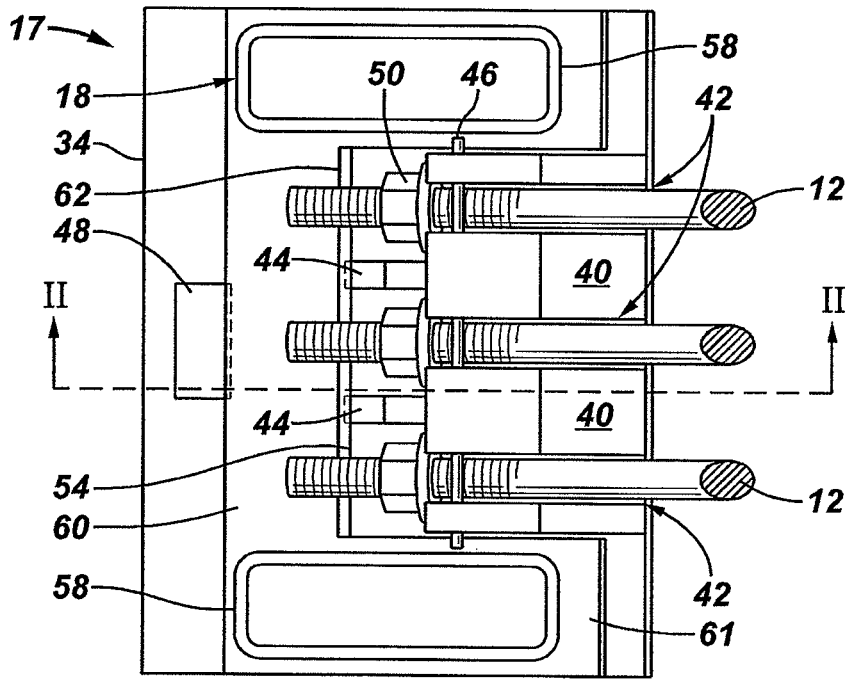
FIG. 8 is a top view of an embodiment of a cable-release anchor according to one or more aspects of the invention.

FIG. 8 is a top view of an embodiment of a cable-release anchor 17 according to one or more aspects of the invention. Leveraging member 18 is disposed atop mounting plate 34 on post landing 54. Base 60 is disposed between post stop 48 and bracket 40 with feet 61 bracketing cable bracket 40. Cables 12 are disposed in slots 42, and terminal end fitting 50 is operated, tensioning cables 12 against bracket 40.

Figure 9:
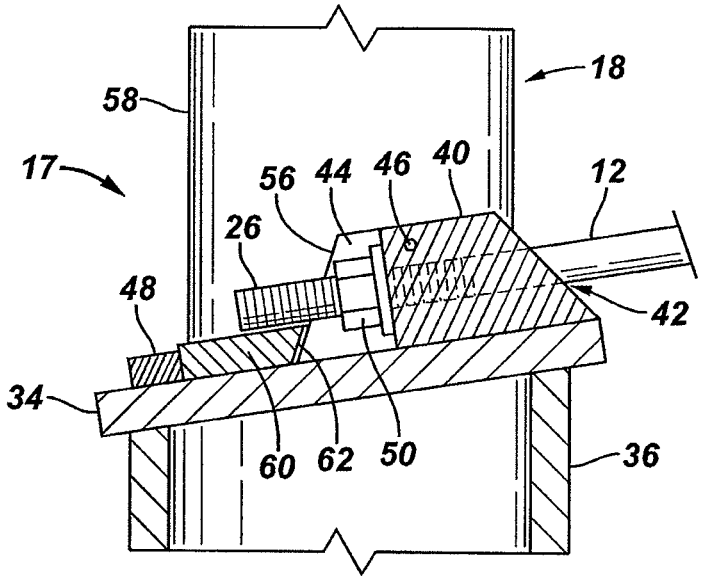
FIG. 9 is a side view of the cable-release anchor along the section line II-II of FIG. 8.

FIG. 9 is a side view of cable-release anchor 17 along the section line II-II of FIG. 8. Base 60 of leveraging member 18 is shown disposed between post stop 48 and bracket 34. Toe 62 is abutting rib face 56. Terminal end 26 of cable 12, or terminal end fitting 50, extends above base 60 of leveraging member 18. In operation, when a vehicle impacts leveraging member 18, base 60 is dislodged from its position between post stop 48 and bracket 40. As leveraging member 18 is dislodged, base 60 leverages cables 12 from slots 42 and bracket 40 thus releasing the tension in cables 12.

Figure 10:
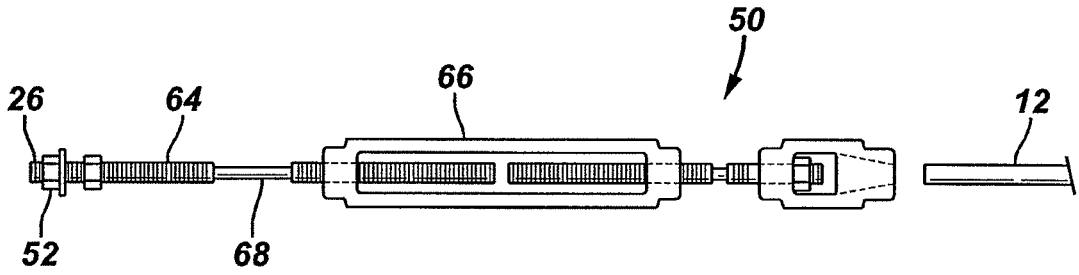
FIG. 10 is an illustration of an embodiment of a terminal end fitting according to one or more aspects of the invention.

FIG. 10 depicts an embodiment of a terminal end fitting 50 according to one or more aspects of the invention. Terminal end fitting 50 includes an elongated shaft 64 connected to cable 12 via a turnbuckle 66. The distal end of elongated shaft 64 becoming terminal end 26 of cable 12. Turnbuckle 66 provides a mechanism for tensioning cable 12. Portions 68 may be provided for positioning, for example, a wrench to rotate shaft 64 relative to turnbuckle 66.

Figure 11:
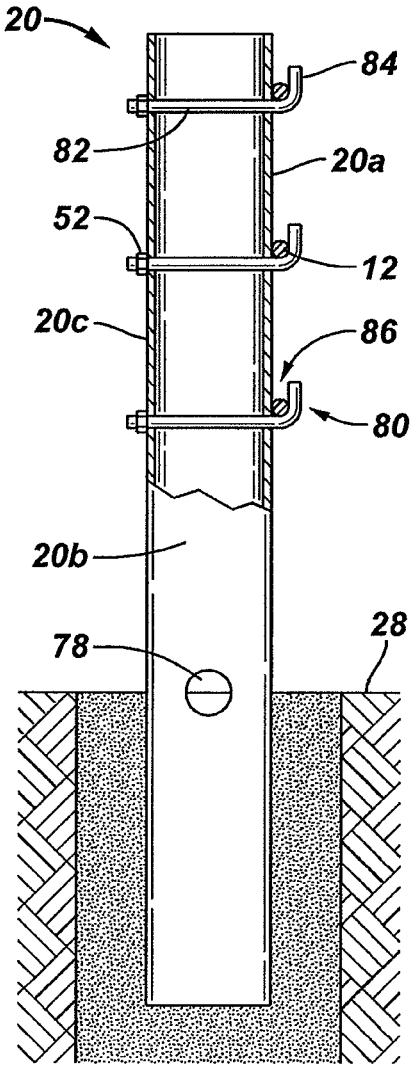
FIG. 11 is a side view of an embodiment of a weak terminal post according to one or more aspects of the invention.
Figure 12:
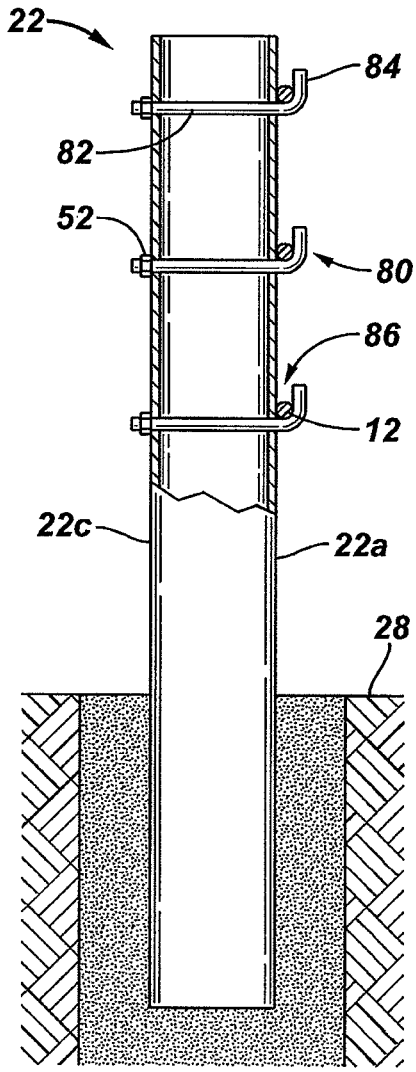
FIG. 12 is a side view of an embodiment of a standard terminal post according to one or more aspects of the invention.

FIG. 11 is a side view of an embodiment of a weak terminal post 20 according to one or more aspects of the invention. Weak terminal post 20 depicted in FIG. 11 includes a hole 78 (e.g., side 20*b*) formed through one or more of its sides proximate ground level 28. FIG. 12 is a side view of an embodiment of a standard terminal post 22 according to one or more aspects of the invention. Terminal posts 20, 22 may be driven in the ground, socketed or supported in any desired manner. Similarly, line posts 24 (FIGS. 1, 14, 15) may be erected by being driven into the ground (i.e., ground level 28), socketed or other wise supported relative to ground level 28.

As previously described, cables 12 are removably mounted to terminal posts 20, 22 and line posts 24 in the depicted embodiment. In the prior art systems, the cables are often connected to the posts (both terminal and line posts) by hook bolts, of various configurations, that substantially enclose the cable. Desirably, these hook bolts expand when needed to release the cable. However, in practice these hook bolts often fail, compromising the barrier system.

With reference to FIGS. 11 and 12, cables 12 are connected to terminal posts 20, 22 by terminal post cable connectors 80. According to one or more aspects of the invention, terminal post cable connectors 80 may be "J-bolts" having a substantially elongated longitudinal rod 82 and a riser 84. Riser 84 extends substantially at a right angle to longitudinal rod 82. With reference to FIG. 11, terminal post cable connector 80 is described for both terminal posts 20 and 22. Terminal post cable connector 80 is connected to terminal post 20 such that riser 84 extends outward from a terminal post face 20*a* and vertically relative to ground level 28 such that a trough 86 is formed for disposing cable 12. Although cables 12 are shown connected to a single side or face of terminal posts 20, 22, and line posts 24 throughout the various figures, it should be realized that for each individual post, cables 12 may be mounted on opposing sides of the post.

Terminal post cable connector 80 may be connected to terminal post 20, 22 by threading a nut 52 to rod 82 or by other suitable means of connection including, but not limited to, welding. A benefit of the system may be that terminal post cable connectors 80 can be connected to their respective terminal post 20, 22 easier and quicker than in the typical prior art systems. A further benefit may be that cables 12 may be released from terminal post cable connectors 80 without deforming the terminal post cable connectors 80. Thus, one terminal post cable connector 80 does not interfere with the clean release of the other cables 12 as may occur in the prior art systems.

Figure 13:
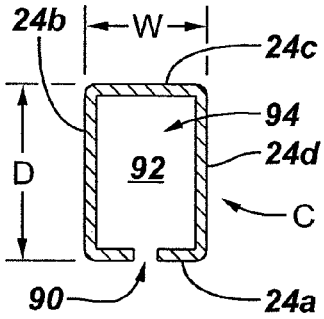
FIG. 13 is a top view of an embodiment of a line post according to one or more aspects of the invention.

With reference to FIG. 13, line post 24 is depicted as a C-section post. Line post 24 is rectangular, and may be a square, having opposing side walls 24*b* and 24*d* defining the depth D, and a post face wall 24*a* and opposing back wall 24*c* defining the width W of line post 24. Post face wall 24*a* forms a longitudinal slot 90 extending at least a portion of the length of line post 24. A cavity 92, having an open top 94, is defined by walls 24*a*, 24*b*, 24*c*, 24*d*. Line post 24 of the invention may take other shapes including without limitation circular.

Line post 24 is substantially the same strength of typical line posts that do not have a slotted section and are stronger than prior art posts split through opposing side walls. For example, line post 24 is a galvanized steel post having a width W of 2.5 inches, a depth D of 3.25 inches and a 0.5 inch slot. Line post 24 weighs 5.4 pounds per foot and has a 75,600 pound bend moment.

Figure 14:
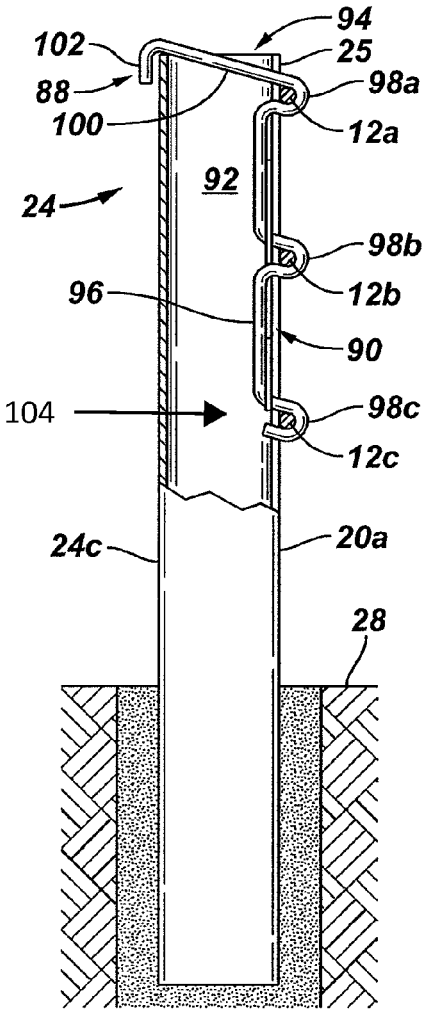
FIG. 14 is a side view of an embodiment of a line post and a hairpin cable connector according to one or more aspects of the invention.

FIG. 14 illustrates an example of cables 12 connected to a line post 24 by a post-cable connector 88 in accordance to one or more aspects of the invention. Post-cable connector 88 is a hairpin shaped connector adapted for removably connecting cables 12 to line post 24. Hairpin connector 88 includes an elongated section 96 forming loops 98, each loop adapted to slidingly hold a cable 12. A top section 100 extends at an angle from longitudinal section 96 and terminates at a hook end section 102. Top section 100 may be angled such as to depart from perpendicular to longitudinal section 96. The angle between top section 100 and longitudinal section 96 may be determined by the distance it is desired to position the top cable 12*a* from the top end 25 of line post 24 and/or ground level 28. For example, in accordance with an embodiment, hairpin connector 88 may be formed of a twenty-four inch long round galvanized steel rod, loops 98*a*, 98*b*, 98*c* are spaced approximately five inches apart, and top loop 98*a* is positioned approximately three inches from top end 25 of line post 24.

Hook end section 102 is angled downward from top end 100 toward ground level 28 when hairpin connector 88 is hung from the top end 25 of line post 24. Hook end section 102 may extend substantially parallel to longitudinal section 96. Hook end section 102 is adapted for mounting on the top end 25 of line post 24.

In operation, cables 12 may be easily inserted into loops 98 through ports 104. Hairpin connector 88 may be grasped at top section 100 and hung on the top end 25 of line-post thereby removably connecting hairpin connector 88 and cables 12 to line post 24. Hairpin connector 88 is positioned with longitudinal section 96 disposed within cavity 92 and loops 98 extending through slot 90. Cables 12 are disposed proximate face wall 24*a* exterior of cavity 92. Top section 100 extends through open top 94 and hook end section 102 extends over back wall 24*c*. When line post 24 is bent toward ground level 28, hairpin connector exits cavity 92 releasing cables 12 from connection with line post 24.

Figure 15:
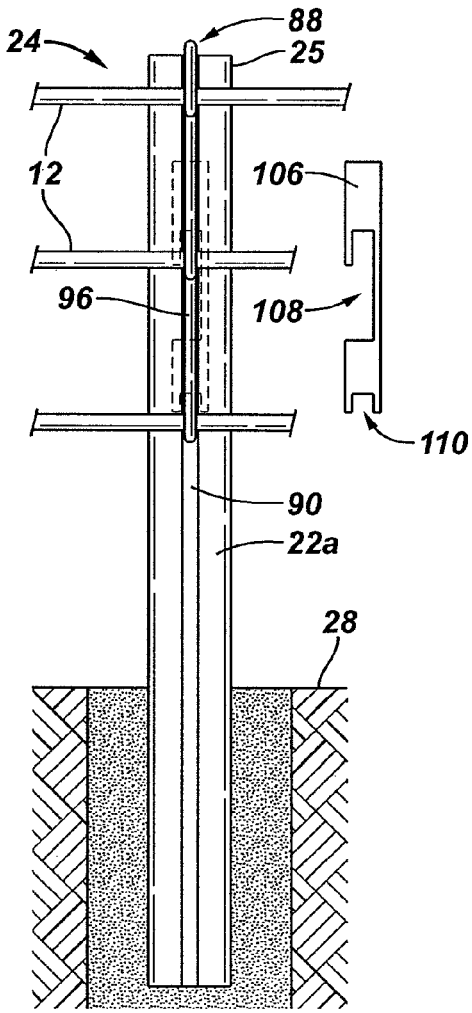
FIG. 15 is a view of an embodiment according to one or more aspects of the invention of a face of the line post to which cables are removably connected illustrating a lock plate.

FIG. 15 is another view of an embodiment of a line post 24 according to one or more aspects of the invention. An optional connection lock plate 106 is depicted adjacent to line post 24. Lock plate 106 is shown in connection with hairpin connector 88 and line post 24 in FIG. 14 and by hidden lines in FIG. 15. Lock plate 106 is configured to connect with hairpin connector 88 and be positioned in cavity 92 abutting the interior of face wall 24*a*. Lock plate 106 facilitates the release of one cable 12 at a time from line post 24. For example, when line post 24 is deformed toward ground level 28, hairpin connector 88 begins to exit open top 94 and top cable 12*a* is released from connection with line post 24. If deformation of line post 24 ceases, cables 12*b* and 12*c* may remain in connection with line post 24 maintaining the integrity of the cable barrier system. If deformation of line post 24 continues, cables 12*b* and 12*c* will be subsequently released from connection with that particular deformed line post 24 but the cables will remain connected to the other line posts 24 and remain supported above ground level 28.

Lock plate 106 illustrated in FIG. 15 is an embodiment for a three-cable barrier system according to one or more aspects of the invention. Depicted lock plate 106 is a substantially flat member having spaced keyways 108 and 110. First keyway 108 is adapted for disposing the middle loop 98*b* and second keyway 110 is adapted to dispose the bottom loop 98*c*.

Figure 16:
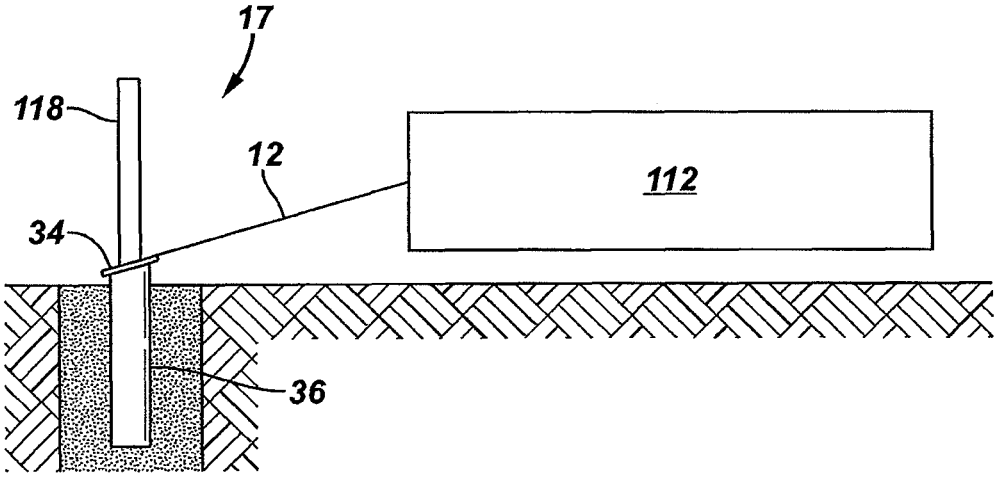
FIG. 16 is a schematic illustration of an embodiment of a cable-release anchor for a barrier system according to one or more aspects of the invention.

FIG. 16 is a schematic of an embodiment of a cable-release anchor 17 according to one or more aspects of the cable barrier system. Cable-release anchor 17 is illustrated releasably holding a single cable 12 in this embodiment. Barrier system 112 of the invention may be a cable barrier system such as described with reference to FIGS. 1 and 2. Other examples of barrier system 112 include, but are not limited to, guardrails, guardrail end treatments, and guardrail end terminals.

Figure 17:
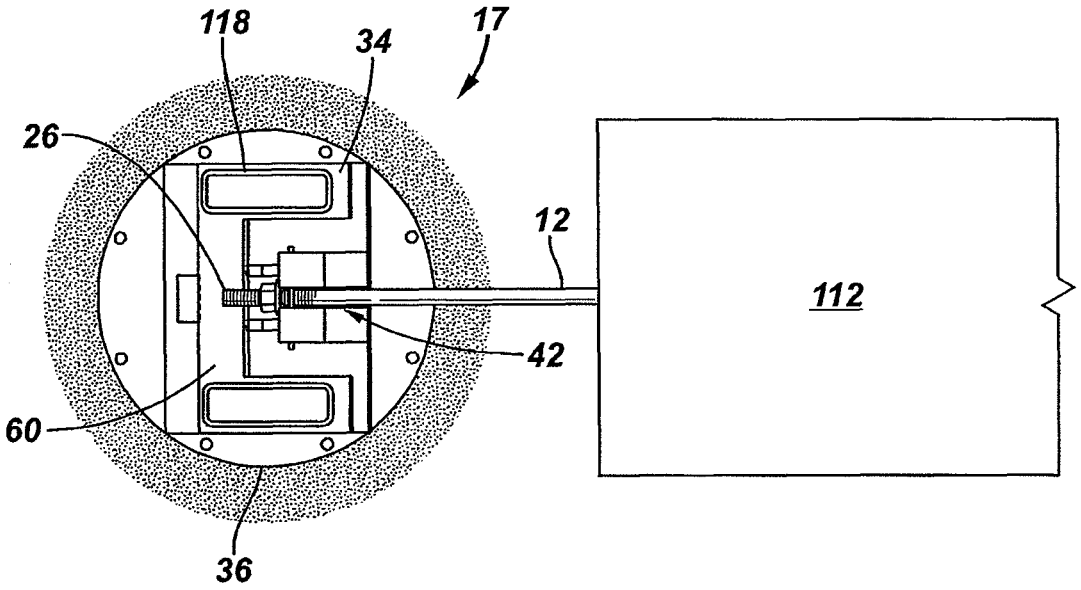
FIG. 17 is a top view of the embodiment of the cable-release anchor depicted in FIG. 16.

FIG. 17 is a top view of the cable-release anchor 17 depicted in FIG. 16. FIG. 17 depicts a single cable 12 releasably connected to cable mounting plate 34. With reference to FIGS. 16 and 17, leveraging member 18 of FIGS. 1 and 2 has been replaced by a leveraging element 118. Leveraging element 118 is defined broadly as a member for releasing cable 12 from anchor plate 34. Leveraging element 118 may include, but is not limited to, elongated post members and terminal heads. The depicted leveraging element 118 has a base member 60 positioned below terminal end 26 of cable 12 in a manner to leverage cable 12 from anchor plate 34 when impacted.

Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method for providing a cable barrier, comprising:

providing a C-section post comprising:

opposing side walls defining a depth;

a face wall and an opposing back wall defining a width;

a cavity defined by the opposing side walls, face wall, and the back wall; and a slot formed through the face wall extending downward from a top end of the C-section post; and releasably connecting a first cable and a second cable to the C-section post via a post-cable connector comprising an elongated section forming a first loop and a second loop, the elongated section disposed substantially within the cavity and the first and second loops extending through the slot exterior of the cavity, the first cable slidingly disposed in the first loop and the second cable slidingly disposed in the second loop, wherein when an object impacts and deforms the C-section post toward ground level the cables are released from the deformed C-section post in a manner such that the cables tend to stay in contact with the impacting object.

2. The method of claim 1, wherein the C-section post is galvanized.

3. The method of claim 1, wherein the face wall has a width of about 2.5 inches and the slot is about 0.5 inches wide.

4. The method of claim 1, wherein the C-section post is galvanized;

the width is about 2.5 inches; and the slot is about 0.5 inches wide.

5. The method of claim 1, wherein the releasably connecting comprises hanging the post-cable connector on the top end of the C-section post.

6. The method of claim 1, further comprising positioning a lock plate within the cavity between the elongated section of the post-cable connector and the face wall.

7. The method of claim 1, wherein the releasably connecting comprises hanging the post-cable connector on the back wall of the C-section post.

8. The method of claim 7, wherein the C-section post is galvanized;

the width is about 2.5 inches; and the slot is about 0.5 inches wide.

9. The method of claim 7, further comprising positioning a lock plate within the cavity between the elongated section of the post-cable connector and the face wall.

10. The method of claim 1, wherein:

the post-cable connector comprises a top section angled from the elongated section and terminating at a hook end; and the releasably connecting comprising hanging the post-cable connector on the back wall of the C-section post with the hook end extending over the back wall such that the loop is positioned exterior of the cavity at a selected distance relative to the top end of the C-section post.

11. The method of claim 10, wherein the C-section post is galvanized;

the width is about 2.5 inches; and the slot is about 0.5 inches wide.

12. The method of claim 10, wherein the angle between the top section and the longitudinal section is determined by the selected distance.

13. A method, comprising:

connecting a post-cable connector comprising an elongated section having a loop to a galvanized C-section post comprising a cavity defined by opposing side walls, a face wall and opposing back wall, a slot formed through the face wall and extending downward from a top end of the C-section post, wherein the connecting the post-cable connector comprises:

hanging a top section of the post-cable connector from the top end of the back wall with the elongated section positioned within the cavity and the loop extending through the slot and positioned exterior of the cavity;

disposing a cable through the loop; and disposing a member in the cavity between the elongated section and the face wall.

14. The method of claim 13, wherein the loop is a top loop relative to a ground level formed by the elongated section of the post-cable connector.

15. The method of claim 13, wherein the face wall is about 2.5 inches wide and the lost about 0.5 inches wide.

16. The method of claim 13, further comprising tensioning the cable.

17. A method for connecting a cable in a cable barrier system to arrest errant motor vehicles that leave a roadway with a post-cable connector comprising an elongated section having a loop and a top section extending from the elongated section and terminating at a hook end, comprising:

providing a galvanized C-section post comprising:

a face wall and opposing back wall defining a width;

opposing side walls defining a depth between the face wall and the back wall;

a cavity defined by the opposing side walls, face wall, and the back wall; and a slot formed through the face wall extending downward from a top end of the C-section post;

disposing the cable in the loop of the post-cable connector; and hanging the top section of the post-cable connector from the back wall of the C-section post such that the elongated section is positioned in the cavity and the loop is disposed through the slot and positioned exterior of the cavity.

18. The method of claim 17, wherein the width is about 2.5 inches and the slot is about 0.5 inches wide.

19. The method of claim 17, further comprising tensioning the cable.

20. The method of claim 17, further comprising positioning a lock plate within the cavity between the elongated section and the face wall.

* * * * *